US009016300B1

(12) United States Patent
Gillespie

(10) Patent No.: US 9,016,300 B1
(45) Date of Patent: Apr. 28, 2015

(54) ARTICULATED SUN SHADE APPARATUS

(71) Applicant: Thomas Gillespie, Carlsbad, NM (US)

(72) Inventor: Thomas Gillespie, Carlsbad, NM (US)

( * ) Notice: Subject to any disclaimer, the term of this patent is extended or adjusted under 35 U.S.C. 154(b) by 0 days.

(21) Appl. No.: 14/510,832

(22) Filed: Oct. 9, 2014

(51) Int. Cl.

| | |
|---|---|
| ***A45B 19/00*** | (2006.01) |
| ***A45B 23/00*** | (2006.01) |
| ***A45B 19/04*** | (2006.01) |
| *A45B 17/00* | (2006.01) |

(52) U.S. Cl.

CPC ..... *A45B 19/04* (2013.01); *A45B 2017/005* (2013.01); *A45B 2023/0087* (2013.01); *A45B 2023/0093* (2013.01); *A45B 23/00* (2013.01)

(58) Field of Classification Search

CPC ..... A45B 2017/005; A45B 2023/006; A45B 2023/0087; A45B 2023/009; A45B 27/00; A45B 23/00; A45B 19/00; A45B 19/04; A45B 19/08; G03B 15/063

USPC ..... 135/20.1, 25.1, 114, 141, 143, 144, 135/149, 151–155; 160/84.07, 134, 351; 248/166, 172, 173, 161; 362/413, 419, 362/428; D3/1, 2, 5

See application file for complete search history.

(56) References Cited

U.S. PATENT DOCUMENTS

| | | | | |
|---|---|---|---|---|
| 3,151,662 | A * | 10/1964 | Fait | 160/32 |
| 4,100,633 | A * | 7/1978 | Pintos | 5/418 |
| 5,682,915 | A * | 11/1997 | Martin | 135/20.1 |
| 6,711,769 | B1 * | 3/2004 | Jane-Prats | 5/639 |
| 2006/0072328 | A1 * | 4/2006 | Chan | 362/382 |
| 2006/0107980 | A1 * | 5/2006 | Freestone | 135/20.1 |
| 2007/0034342 | A1 * | 2/2007 | Fill | 160/351 |

* cited by examiner

*Primary Examiner* — Robert Canfield

(74) *Attorney, Agent, or Firm* — Willams Intellectual Property; Benjamin F. Williams

(57) ABSTRACT

An articulated sun shade apparatus including a fan member disposed endwise upon an elongate telescopic arm portion, said arm portion rotationally connected at a first pivot point slidingly securable along the length of an elongate base portion, wherein said arm portion is securable between a stowed position, disposed in contact and parallel with the base portion, and a deployed position, pivoted away from said base portion, whereby the fan member is moveable between a collapsed situation and a flared situation to position a plurality of blade members adjacently within a circular section appropriate to cast shade with precision, as desired.

9 Claims, 5 Drawing Sheets

ARTICULATED SUN SHADE APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of sun shade apparatuses are known in the prior art. However, what is needed is an articulated sun shade apparatus that includes a fan member disposed endwise upon an elongate telescopic arm portion, said arm portion rotationally connected at a first pivot point slidingly securable along the length of an elongate base portion, wherein said arm portion is securable between a stowed position, disposed in is contact and parallel with the base portion, and a deployed position, pivoted away from said base portion, whereby the fan member is moveable between a collapsed situation and a flared situation to position a plurality of blades adjacently within a circular section appropriate to cast shade with precision, as desired.

FIELD OF THE INVENTION

The present invention relates to an articulated sun shade apparatus, and more particularly, to an articulated sun shade apparatus including a fan member disposed endwise upon an elongate telescopic arm portion, said arm portion rotationally connected at a first pivot point slidingly securable along the length of an elongate base portion, wherein said arm portion is securable between a stowed position, disposed in contact and parallel with the base portion, and a deployed position, pivoted away from said base portion, whereby the fan member is moveable between a collapsed situation and a flared situation to position a plurality of blades adjacently within a circular section appropriate to cast shade with precision, as desired.

SUMMARY OF THE INVENTION

The general purpose of the articulated sun shade apparatus, described subsequently in greater detail, is to provide an articulated sun shade apparatus which has many novel features that result in an articulated sun shade apparatus which is not anticipated, rendered obvious, suggested, or even implied by prior art, either alone or in combination thereof.

The present articulated sun shade apparatus has been devised to enable precision projection of shade, as desired, effective by the selective positioning of a fan member, disposed distally endwise upon a telescopic arm portion rotatably connected to an elongate base portion, to obscure a light or heat source such as, for example, the sun, as desired. The fan member is deployable into a flared situation whereby a plurality of blades is spreadable adjacent one another to occupy a circular section. The present apparatus is articulated to enable selective positioning of the fan member within a hemispheric space surrounding the elongate base portion, as will be described subsequently, whereby shade is enjoyable proximal said apparatus by obscuration of a light and/or heat source located anywhere above a ground surface.

The present articulated sun shade apparatus, therefore, includes an elongate base portion disposed for position upon a ground surface. The elongate base portion includes a recessed channel disposed longitudinally thereatop, said reessed channel disposed between a first end and a second end of the base portion. A first pivot point is disposed travelable within the recessed channel, wherein the first pivot point is securable upon the recessed channel between the first end and the second end of the base portion and a telescopic arm portion, pivotally connected endwise upon the first pivot point, is selectively positional, as desired, along the length of the elongate base portion.

The first pivot point is rotational through three-hundred-and-sixty degrees around an axis perpendicular relative the elongate base portion. The telescopic arm portion is is pivotal upon the first pivot point through at least one hundred-and-eighty-degrees, from a stowed position, wherein the arm portion is disposed in contact with the recessed channel and parallel with the elongate base portion, through a deployed position, wherein the arm portion is pivoted away from said base portion.

The telescopic arm portion includes a plurality of telescoping extensible members longitudinally applicable to increase the length of said arm portion, whereby said arm portion is extendible lengthwise along an axis congruent therewith. A second pivot point is disposed endwise upon the telescopic arm portion to situate a flared fan seat through three-hundred-and-sixty degrees of rotation around an axis congruent with a medial axis of the telescopic arm portion, said flared fan seat further pivotal through at least one-hundred-and-eighty degrees upon the second pivot point.

The fan member is dispositional within the flared fan seat between a collapsed situation, wherein each of a plurality of blades is positioned in parallel in relation to one another, and a flared situation, whereby each of said plurality of blades is spread adjacent one another to occupy a circular section. The fan member is thus deployable to obscure any point located within a hemispheric space surrounding the elongate base member delimited only by the length of the telescopic arm portion.

A plurality of hasp members is disposed upon the elongate base portion to engage the telescopic arm portion in the stowed position and maintain compactness of the apparatus during portage and storage. To deploy the apparatus for selective and precision shading of a user, as desired, each of the plurality of hasp members is released and the telescopic arm portion is pivoted away from the base portion. The first pivot point is thence travelable upon the base portion, when desired, and securable is appropriate for application of particular shading. The telescopic arm portion is extensible to delimit a desired length relative the base portion, whence the fan member is deployable to the flared situation to enable obscuration of a desired light and/or heat source whereby a user is enabled enjoyment of precision application of shade, as desired.

Thus has been broadly outlined the more important features of the present articulated sun shade apparatus so that the detailed description thereof that follows may be better understood and in order that the present contribution to the art may be better appreciated.

Objects of the present articulated sun shade apparatus, along with various novel features that characterize the invention are particularly pointed out in the claims forming a part of this disclosure. For better understanding of the articulated sun shade apparatus, its operating advantages and specific objects attained by its uses, refer to the accompanying drawings and description.

BRIEF DESCRIPTION OF THE DRAWINGS FIGURES

DETAILED DESCRIPTION OF THE DRAWINGS

Figure 1:
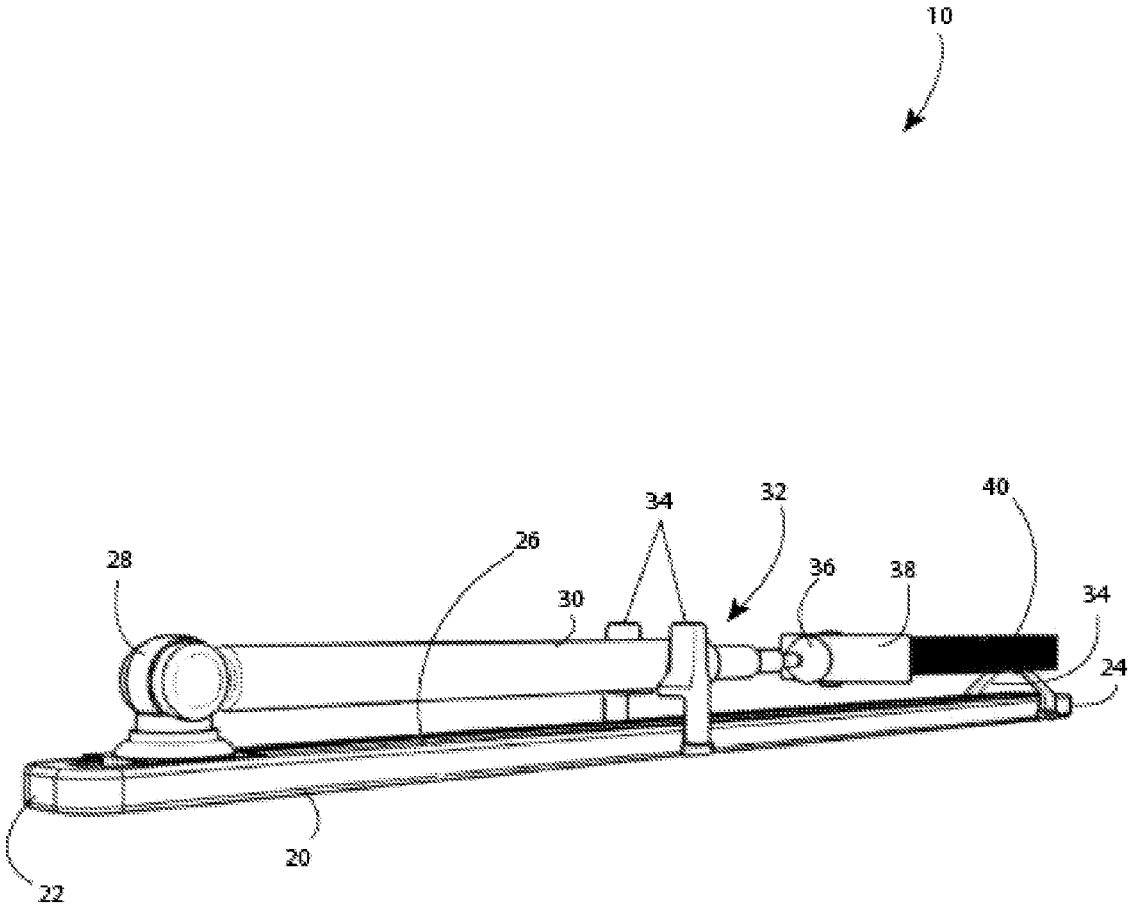
FIG. 1 is an isometric view of an embodiment disposed in a stowed position.
Figure 2:
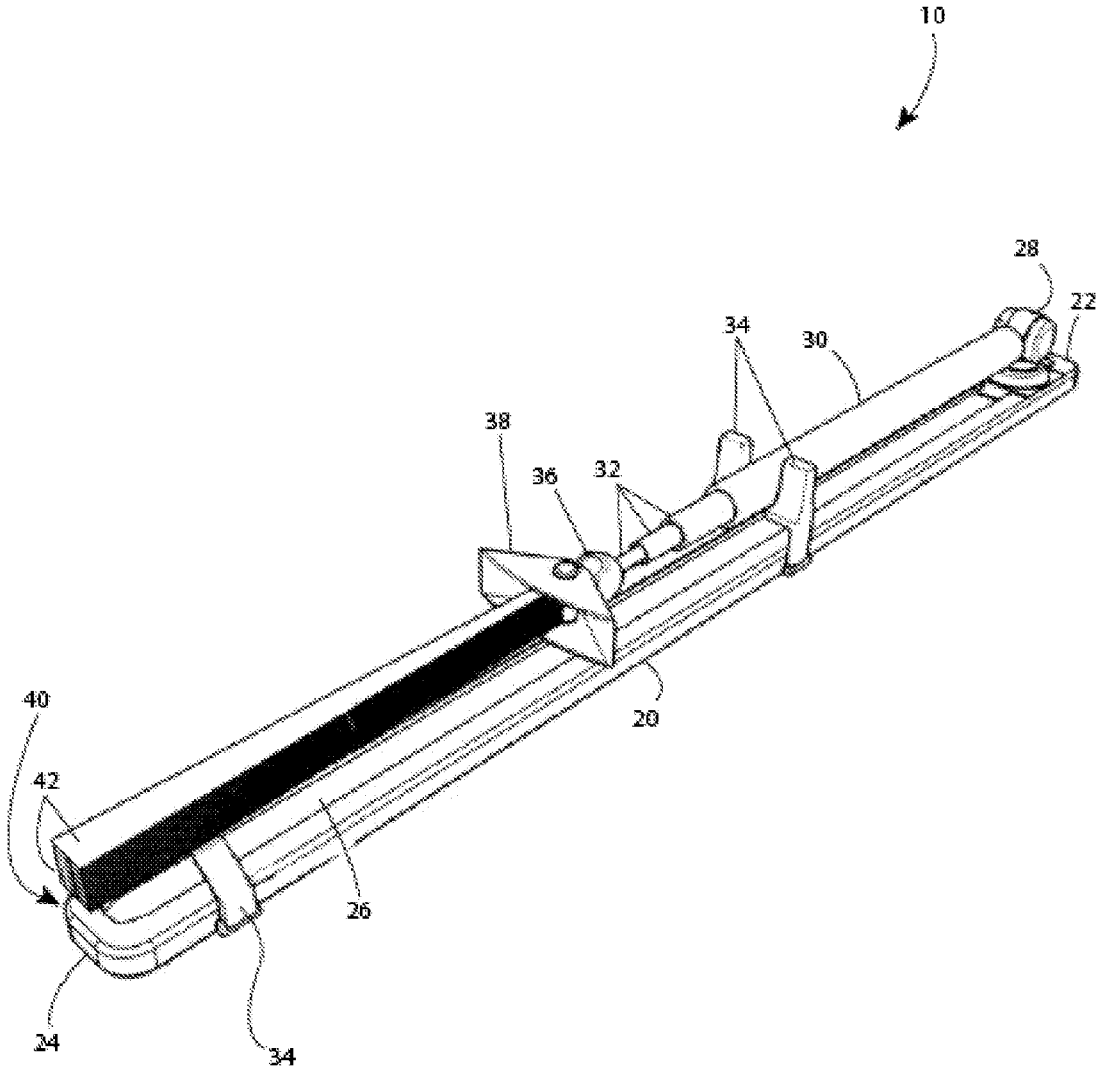
FIG. 2 is an isometric view of an embodiment disposed in a stowed position.
Figure 3:
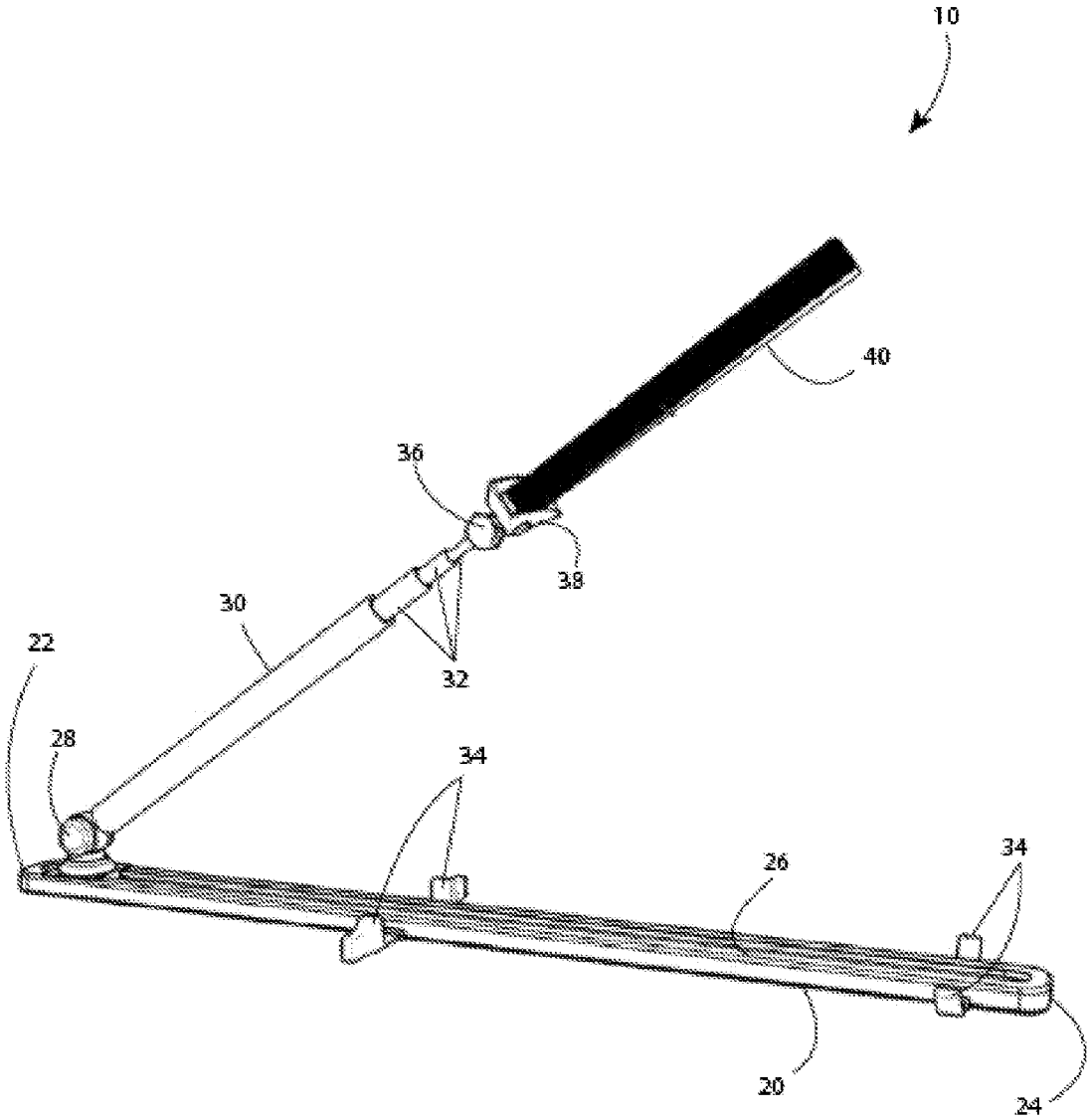
FIG. 3 is a side view of an embodiment moved to a deployed position with a fan member disposed in a collapsed situation.
Figure 4:
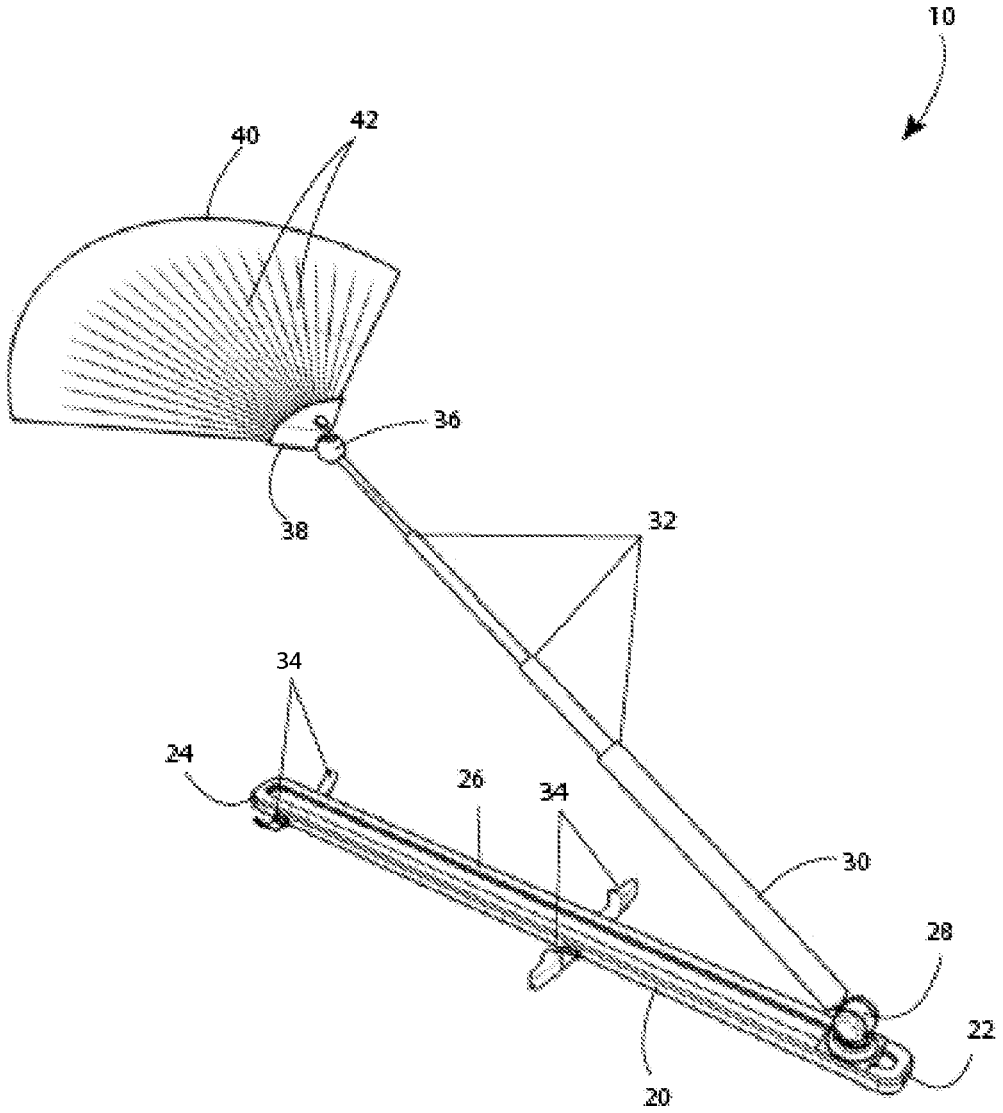
FIG. 4 is an isometric view of an embodiment disposed in a deployed position with a telescopic arm portion extended and a fan member disposed in a flared situation.
Figure 5:
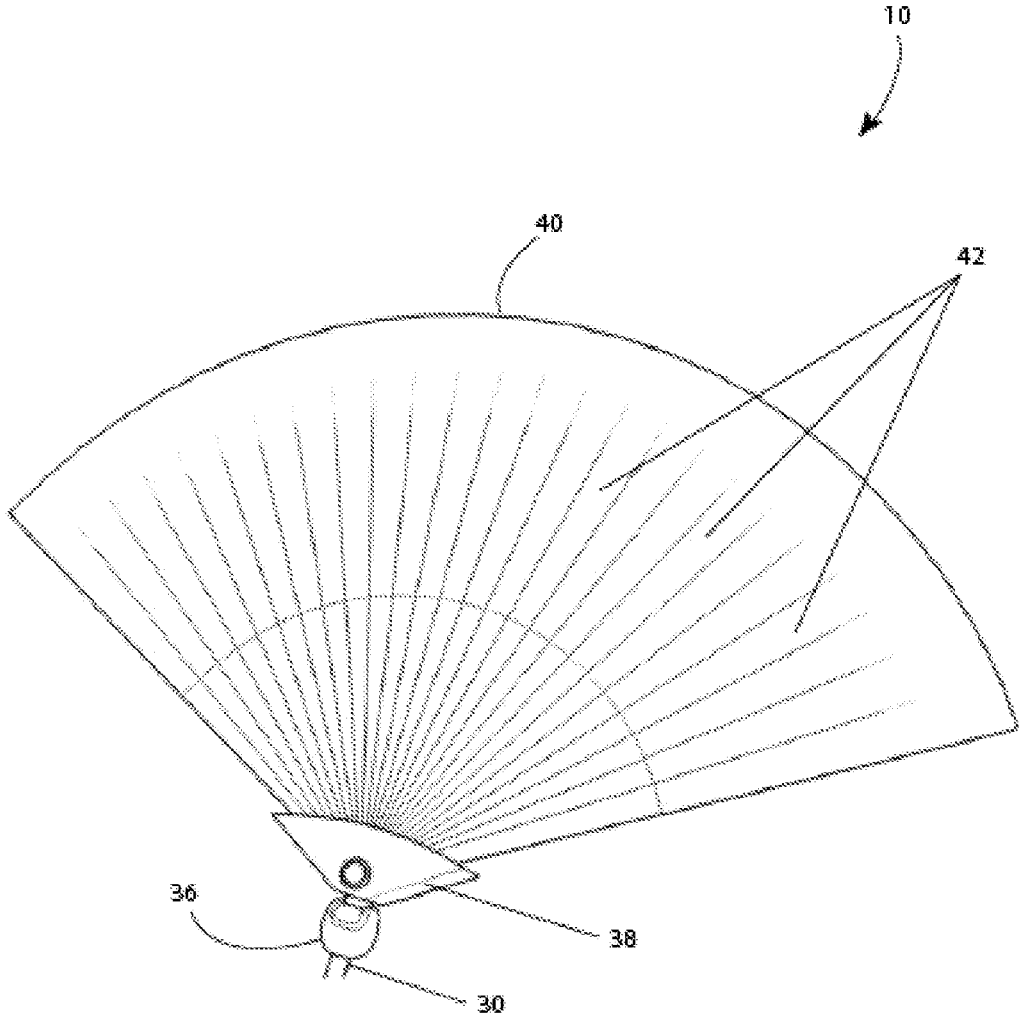
FIG. 5 is a detail view of an embodiment of a fan member disposed in a flared situation.

With reference now to the drawings, and in particular FIGS. 1 through 5 thereof, example of the instant articulated sun shade apparatus employing the principles and concepts of the present articulated sun shade apparatus and generally designated by the reference number 10 will be described.

Referring to FIGS. 1 through 5 a preferred embodiment of the present articulated sun shade apparatus 10 is illustrated.

The present articulated sun shade apparatus 10 has been devised to enable selective positioning of a fan member to obscure a light and/or heat source and thereby project precision shading, as desired. The fan member is disposed endwise upon a telescopic arm portion positional upon a second pivot point, whereby each of a plurality of blades of the fan member is situational to occupy a circular section and a particular light and/or heat source (including, for example, the sun) is obscurable to precisionally direct shade, as desired.

The present articulated sun shade apparatus 10, therefore, includes an elongate base portion 20 disposed to overlie a ground surface. The base portion 20 includes a recessed channel 26 longitudinally disposed between a first end 22 and a second end 24 of said base portion 20. A first pivot point 28 is slidably securable along the length of the recessed channel 26, and situational at the first end 22, as desired. The first pivot point 28 is rotatable through three-hundred-and-sixty degrees around an axis perpendicular relative the elongate base portion 20.

The telescopic arm portion 30 is disposed upon the first pivot point 28 and is pivotal thereon through at least one-hundred-and-eighty degrees. Thus the telescopic arm portion 30 is rotatable upon the first pivot point 28 around its own axis and pivotal relative the elongate base portion 20, as desired. The telescopic arm portion 30 includes a plurality of telescopically extensible members 32 slidinglly disposed to extend the length of said arm portion 30, as desired.

When the first pivot point 28 is positioned at the first end 22 of the base portion 20, the telescopic arm portion 30 is positional to a stowed position, thence disposed parallel and in contact with the elongate base portion 20 interior to the recessed channel 26. A plurality of hasp members 34 is securable to maintain the arm portion 30 in the stowed position. Release of each of the plurality of hasp members 34, and pivoting of the arm portion 30 out of the recessed channel 26 moves the arm portion 30 to a deployed position, situated apart from the base portion 20 and thence extendable, as desired, while enabling travel of the first pivot point 28 within the recessed channel 26 along the length of the base portion 20.

A second pivot point 36 is disposed endwise upon the telescopic arm portion 30, said second pivot point 36 likewise rotatable around an axis congruent with the arm portion 30 through three-hundred-and-sixty-degrees whereby the fan member 40, attached thereto within a flared fan seat 38, is rotational about same axis.

The fan member 40 is disposed with a flared fan seat 38, said flared fan seat 38 disposed pivotally upon the second pivot point 36. The flared fan seat 38 is pivotal upon the second pivot point 36 through at least one-hundred-and-eighty degrees within a plane transverse the arm member 30, whereby the fan member 40 is selectively positional to obscure a determined point within a space hemispherically disposed surrounding the base portion 20, delimited only by the length of the arm portion 30.

The fan member 40 is seated in the fan seat 38 and includes a plurality of blades 42 dispositional between a collapsed situation, whereby said plurality of blades 42 is disposed in parallel relative one another, and a flared situation, whereby each of said plurality of blades 42 is spread to rest adjacently relative one another to comprise a circular section.

Thus the arm portion 30 is securable in the recessed channel 26 when disposed in the stowed position between each of the plurality of hasp members 34 for convenient storage and ready portage, and the fan member 40 is positional upon the telescopic arm portion 30 through three-hundred-and-sixty degrees relative the elongate base portion 20, said first pivot point 28 securable along the length of the recessed channel 26 when said telescopic arm portion 30 is moved to the deployed situation, whereby said fan member 40 is situational in the flared situation to produce precision application of shading, as desired.

What is claimed is:

1. An articulated sun shade apparatus comprising a fan member disposed endwise upon an elongate telescopic arm portion, said arm portion rotationally connected at a first pivot point slidingly securable along the length of an elongate base portion, wherein said arm portion is securable between a stowed position, disposed in contact and parallel with the base portion, and a deployed position, pivoted away from said base portion, whereby the fan member is moveable between a collapsed situation and a flared situation to position a plurality of blades adjacently disposed within a circular section appropriate to cast shade with precision, as desired.

2. The articulated sun shade apparatus of claim 1 wherein the telescopic arm portion includes a plurality of telescoping extensible members slidingly extendable longitudinally therein, each of said plurality of telescoping extensible members securable to increase a length of the arm portion as desired.

3. The articulated sun shade apparatus of claim 2 wherein the telescopic arm portion is pivotally attached to the base portion at said first pivot point, said first pivot point rotatable through three-hundred-and-sixty degrees around an axis perpendicular with respect to the base portion.

4. The articulated sun shade apparatus of claim 3 wherein the fan member is disposed moveable between the collapsed situation and the flared situation within a flared fan seat.

5. The articulated sun shade apparatus of claim 4 wherein the flared fan seat is pivotally attached to the telescopic arm portion at a second pivot point, said second pivot point rotatable through three-hundred-and-sixty degrees around an axis congruent with the arm portion.

6. The articulated sun shade apparatus of claim 5 wherein the elongate base portion further comprises an elongate recessed channel disposed longitudinally thereatop, said recessed channel disposed to receive the telescopic arm portion therein when said arm portion is moved to the stowed position.

7. The articulated sun shade apparatus of claim 6 wherein the base portion further includes a plurality of hasp members fastenable together to secure the arm portion interior to the recessed channel when said arm portion is moved to the sowed position.

8. The articulated sun shade apparatus of claim 7 wherein the first pivot point is slidingly securable along the length of the recessed channel when the telescopic arm portion is moved to the deployed position.

9. An articulated sun shade apparatus comprising:

an elongate base portion having a recessed channel longitudinally disposed between a first end and a second end thereof;

a plurality of hasp members disposed upon the base portion, said plurality of hasp members securable between a closed position and an open position;

a rotatable first pivot point slidingly disposed securable along the length of the recessed channel, said first pivot point rotatable through three-hundred-and-sixty degrees around an axis perpendicular relative the elongate base portion;

a telescopic arm portion disposed upon the first pivot point, said telescopic arm portion having a plurality of telescopically extensible members slidinglly disposed therein, said telescopic arm portion pivotal upon the first pivot point through at least one-hundred-and-eighty-degrees from a stowed position, disposed parallel and in contact with the elongate base portion interior to the recessed channel, and a deployed position, situated apart from the base portion and extended, as desired;

a second pivot point disposed endwise upon the telescopic arm portion, said second pivot point rotatable through three-hundred-and-sixty-degrees;

a flared fan seat disposed pivotally upon the second pivot point, said fan seat pivotal thereon through at least one-hundred-and-eighty degrees; and a fan member disposed seated in the fan seat, said fan member having a plurality of blades dispositional between a collapsed situation, with said plurality of blades disposed in parallel relative one another, and a flared situation, with each of said plurality of blades spread to rest adjacently comprising a circular section;

wherein the arm portion is securable in the recessed channel when disposed in the stowed position engaged at each of the plurality of hasp members and the fan member is positional upon the telescopic arm portion through three-hundred-and-sixty degrees relative the elongate base portion, when said telescopic arm portion is moved to the deployed situation, said fan member thereby situational in the flared position to produce precision application of shading, as desired, occupying any point located hemispherically relative the base portion and delimited thereat by the length of the arm portion.

* * * * *